US011784445B2

(12) United States Patent
Hamada et al.

(10) Patent No.: US 11,784,445 B2
(45) Date of Patent: Oct. 10, 2023

(54) JOINT CONNECTOR

(71) Applicant: Yazaki Corporation, Tokyo (JP)

(72) Inventors: Ryo Hamada, Shizuoka (JP); Minoru Kubota, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/903,218

(22) Filed: Sep. 6, 2022

(65) Prior Publication Data

US 2023/0071595 A1 Mar. 9, 2023

(30) Foreign Application Priority Data

Sep. 7, 2021 (JP) ..... 2021-145141

(51) Int. Cl.
*H01R 24/54* (2011.01)

(52) U.S. Cl.
CPC ..... *H01R 24/547* (2013.01)

(58) Field of Classification Search
CPC ..... H01R 24/547; H01R 24/62; H01R 31/06
See application file for complete search history.

(56) References Cited

U.S. PATENT DOCUMENTS

2004/0257830 A1* 12/2004 Okabe ..... B60Q 3/20 362/555
2007/0064450 A1* 3/2007 Chiba ..... B60Q 1/2696 362/655

FOREIGN PATENT DOCUMENTS

JP 2005011730 A * 1/2005 ..... B60Q 3/20
JP 2006-019126 A 1/2006
JP 2014104918 A * 6/2014
WO WO-2011027516 A1 * 3/2011 ..... B60Q 1/0094

* cited by examiner

*Primary Examiner* — Jean F Duverne
(74) *Attorney, Agent, or Firm* — Sughrue Mion, PLLC

(57) ABSTRACT

A joint connector includes one or more connecting units, in which one of the connecting units includes: a plurality of conductors; and a housing that holds the plurality of conductors, the conductor includes: trunk portions each of which having first ends and second ends; and branch portions each of which diverging from the trunk portion, the branch portion includes an output terminal portions, the housing includes: a first coupling portion disposed on a side of the first end; and a second coupling portion disposed on a side of the second end, and the first coupling portion of one of the housings and the second coupling portion of another one of the housings are coupled each other, causing the first end of the conductor and the second end of another one of the conductors to be connected to each other.

4 Claims, 6 Drawing Sheets

JOINT CONNECTOR

CROSS-REFERENCE TO RELATED APPLICATIONS

The present application claims priority to and incorporates by reference the entire contents of Japanese Patent Application No, 2021-145141 filed in Japan on Sep. 7, 2021.

BACKGROUND OF THE INVENTION

1. Field of the Invention

The present invention relates to a joint connector.

2. Description of the Related Art

There is a conventionally known joint connector. Japanese Patent Application Laid-open No. 2006-19126 discloses a joint connector including a connector housing and a joint terminal attached to the connector housing by press fitting. In the joint connector of Japanese Patent Application Laid-open No. 2006-19126, the joint terminals are attached, in four stages, to the connector housing.

In the joint connector of Japanese Patent Application Laid-open No. 2006-19126, the housing that houses the joint terminal is likely to be thick. A thick joint connector is likely to be restricted in terms of arrangement locations. In addition, the joint connector that houses terminals in stack has difficulty in achieving the thinning of a device that houses the joint connector. Thus, it is desired to achieve height reduction in the joint connector.

SUMMARY OF THE INVENTION

An object of the present invention is to provide a joint connector capable of reducing the height.

In order to achieve the above mentioned object, a joint connector according to one aspect of the present invention includes one or more connecting units that can be coupled to each other, wherein one of the connecting units includes: a plurality of conductors each having a plate-like shape; and a housing that holds the plurality of conductors, the conductor includes: trunk portions each of which having a straight line shape, extending in a first direction, and having a first end and a second end; and branch portions each of which diverging from the trunk portions in a second direction orthogonal to the first direction, the branch portion includes an output terminal portion connected to a terminal of another connector, the housing holds the plurality of conductors in a state where the output terminal portions of the plurality of conductors are arranged in parallel in the first direction on a same plane, the housing includes: a first coupling portion disposed on a side of the first end; and a second coupling portion disposed on a side of the second end, and the first coupling portion of one of the housings and the second coupling portion of another one of the housings are coupled each other, causing the first end of the conductor and the second end of another one of the conductors to be connected to each other.

The above and other objects, features, advantages and technical and industrial significance of this invention be better understood by reading the following detailed description of presently preferred embodiments of the invention, when considered in connection with the accompanying drawings.

DETAILED DESCRIPTION OF THE PREFERRED EMBODIMENTS

Hereinafter, a joint connector according to an embodiment of the present invention will be described in detail with reference to the drawings. Note that the present invention is not limited by this embodiment. Moreover, components in the following embodiment include those that are easily conceivable for those skilled in the art or substantially identical.

Embodiment

Figure 1:
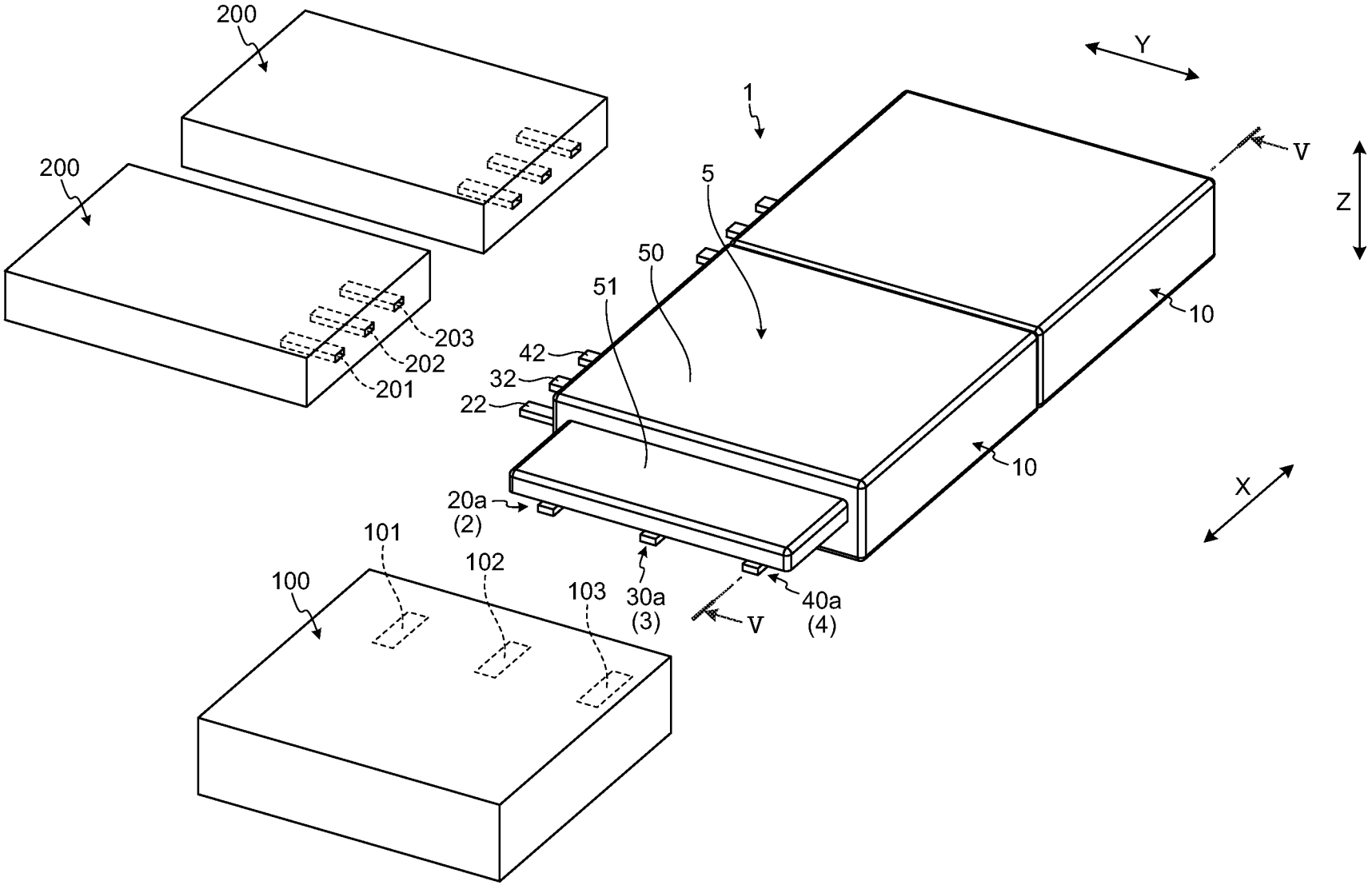
FIG. 1 is a perspective view of a joint connector according to an embodiment.
Figure 2:
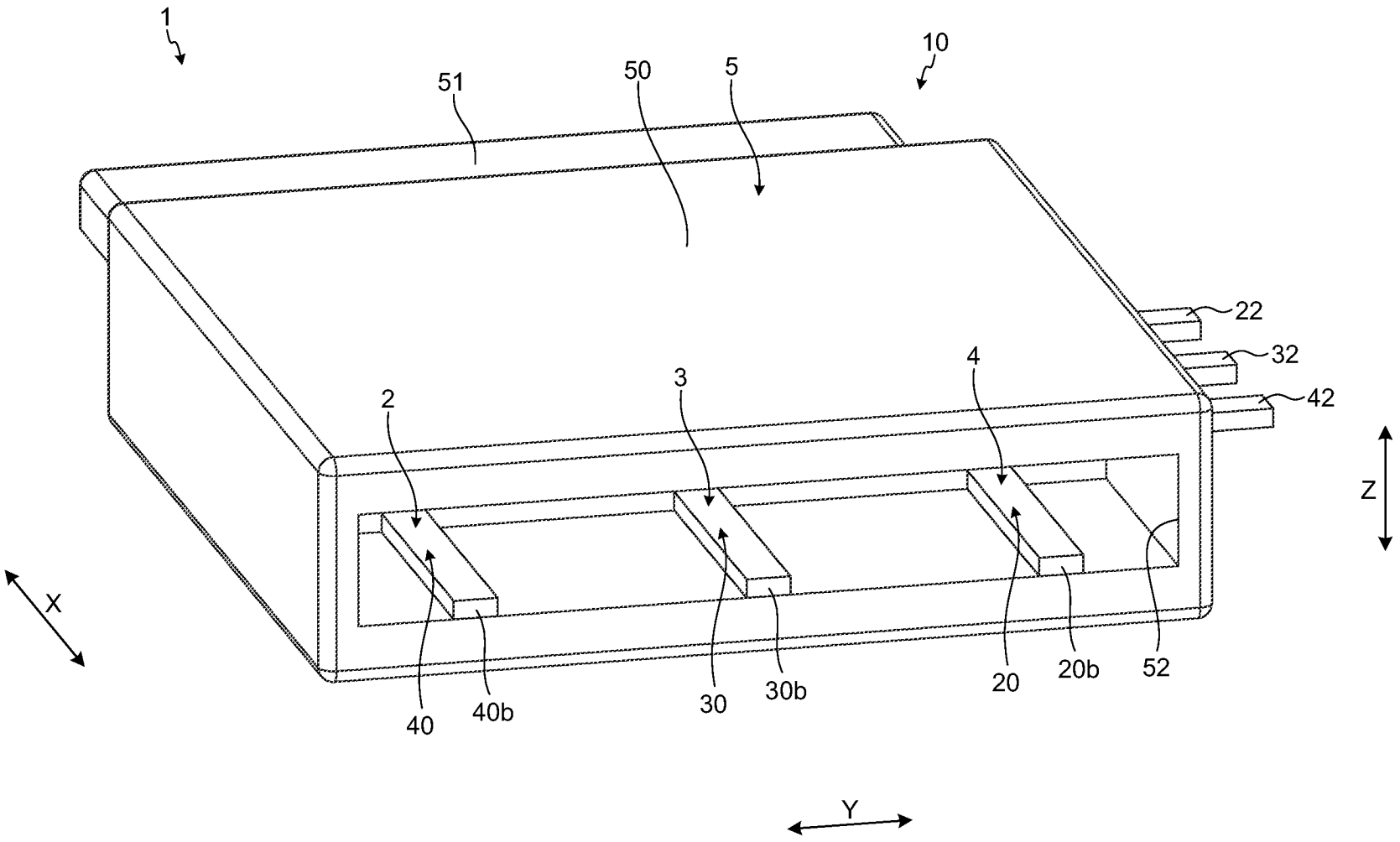
FIG. 2 is a perspective view of a connecting unit according to the embodiment.
Figure 3:
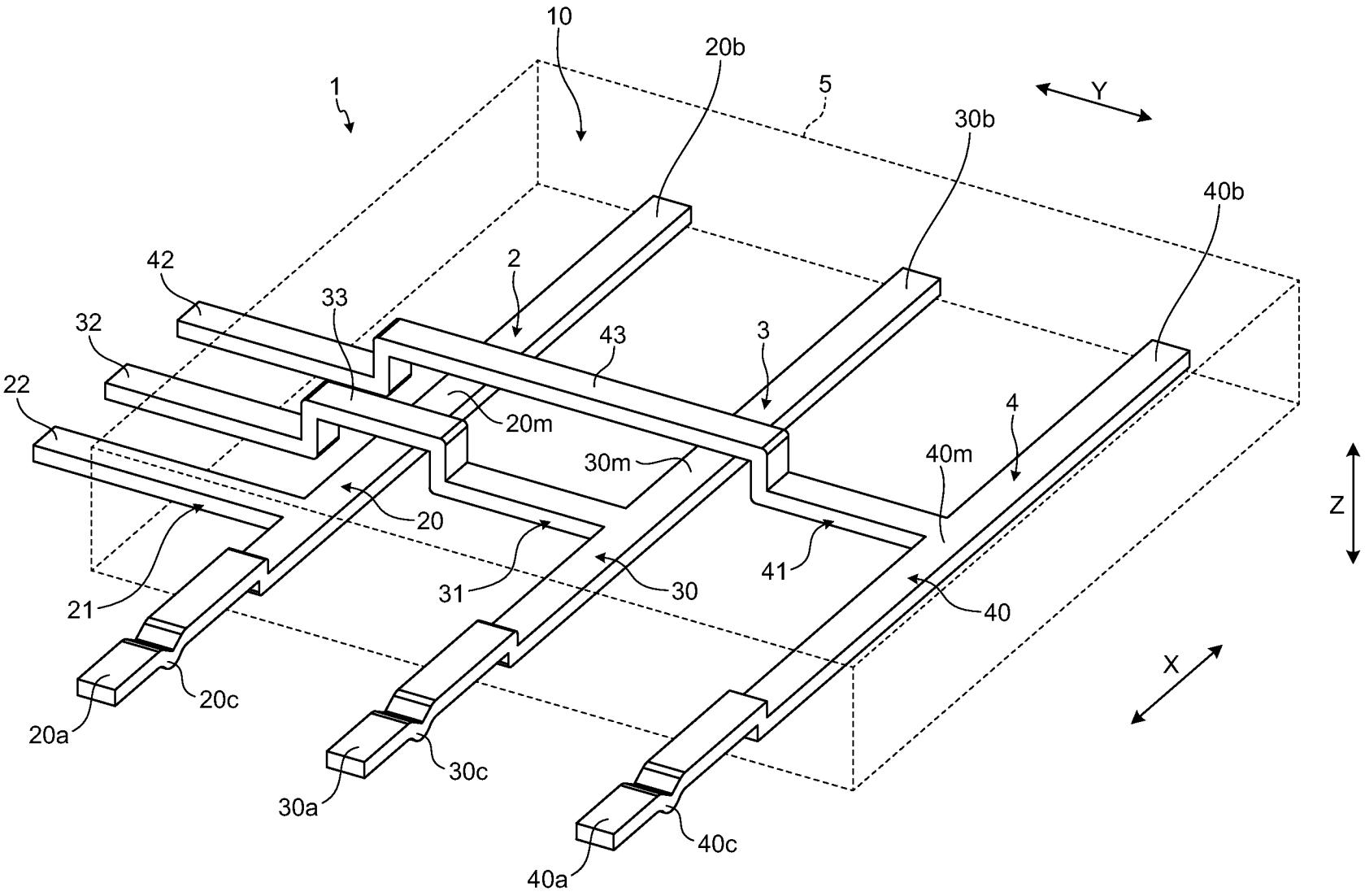
FIG. 3 is a perspective view of a conductor according to the embodiment.
Figure 4:
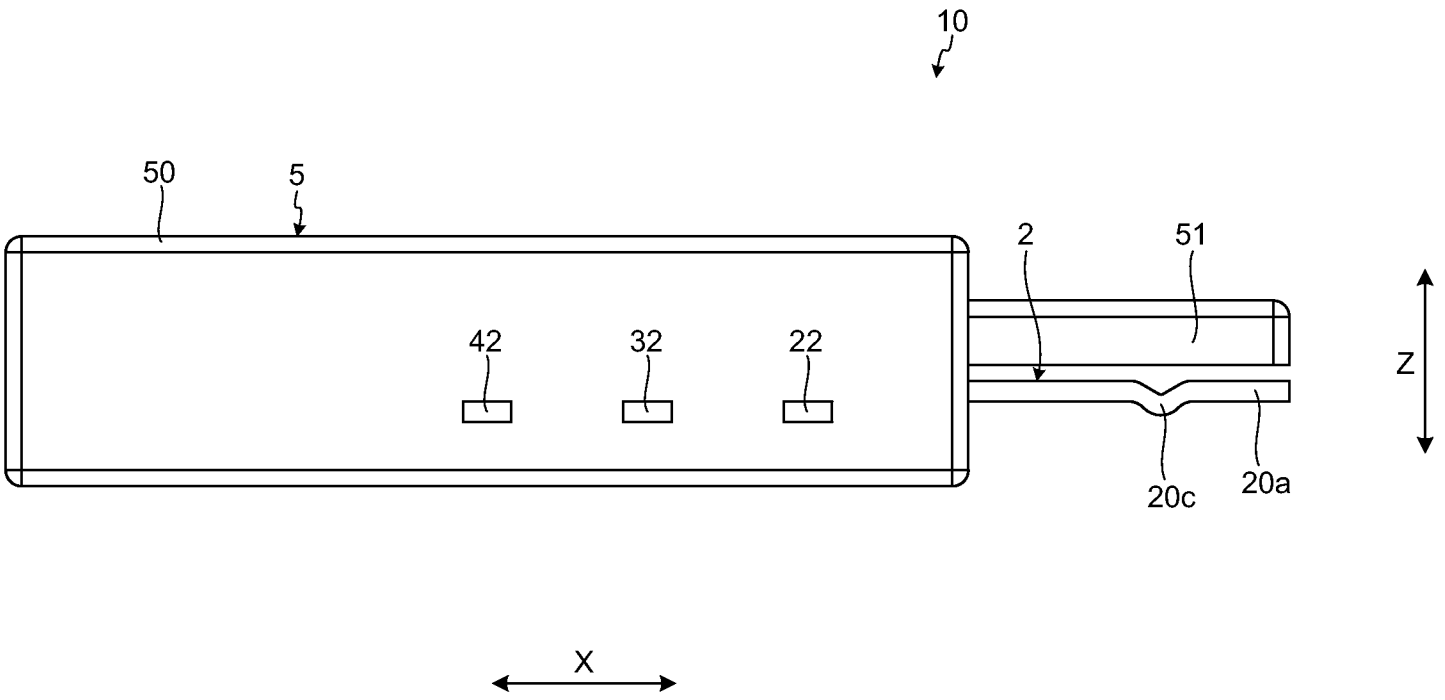
FIG. 4 is a side view of the connecting unit according to the embodiment.
Figure 5:
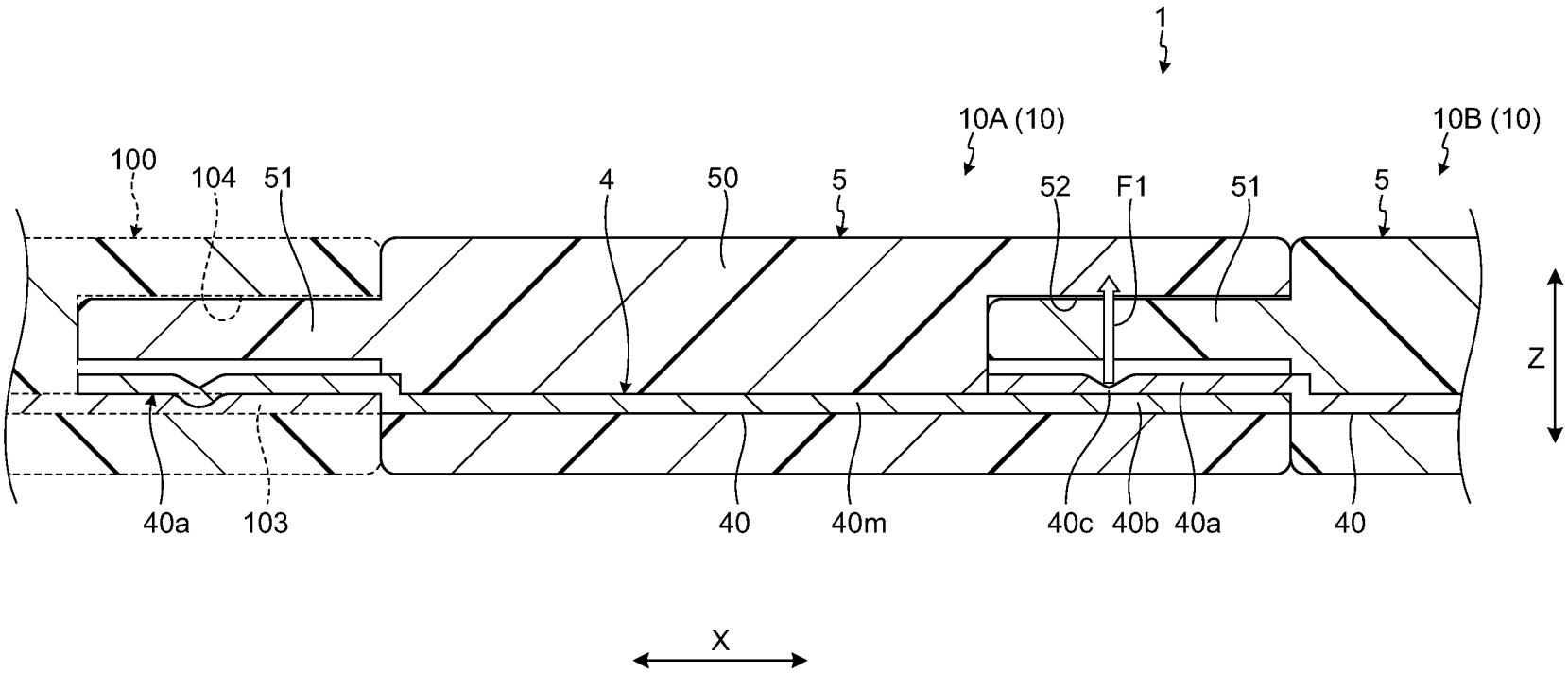
FIG. 5 is a cross-sectional view of the joint connector according no the embodiment.

An embodiment will be described with reference to FIGS. 1 to 5. The present embodiment relates no a joint connector. FIG. 1 is a perspective view of a joint connector according to an embodiment; FIG. 2 is a perspective view of a connecting unit according to the embodiment; FIG. 3 is a perspective view of a conductor according to the embodiment; FIG. 4 is a side view of the connecting unit according to the embodiment, and FIG. 5 is a cross-sectional view of the joint connector according to the embodiment. FIG. 5 illustrates a cross section taken along line V-V in FIG. 1.

A joint connector 1 illustrated in FIG. 1 is mounted on a vehicle such as an automobile, for example. The joint connector 1 connects, for example, a power supply and a control device of a vehicle to a plurality of devices mounted on the vehicle. The joint connector 1 of the present embodiment has a thin shape and thus can be disposed in a narrow space. The joint connector 1 may be arranged on a door of the vehicle. In this case, the joint connector 1 can contribute to thinning of the door.

As illustrated in FIG. 1, the joint connector 1 of the present embodiment includes a connecting unit 10 that can be coupled to each other. The connecting unit 10 includes a first conductor 2, a second conductor 3, a third conductor 4, and a housing 5. The housing 5 holds the first conductor 2, the second conductor 3, and the third conductor 4. The housing 5 is molded using an insulating synthetic resin, for example.

The housing 5 includes a main body 50 having a rectangular parallelepiped shape, and a first coupling portion 51. The main body 50 holds the first conductor 2, the second conductor 3, and the third conductor 4. The first coupling portion 51 is fitted to a second coupling portion 52 illustrated in FIG. 2 to couple the two connecting units 10 to each other.

FIG. 3 illustrates the first conductor 2, the second conductor 3, and the third conductor 4 held by the housing 5. As illustrated in FIG. 3, the first conductor 2, the second conductor 3, and the third conductor 4 are plate-shaped conductors referred to as busbars. The first conductor 2, the second conductor 3, and the third conductor 4 are formed of a conductive metal plate such as copper or aluminum.

The first conductor 2 includes a trunk portion 20 and a branch portion 21. The trunk portion 20 extends in straight line and includes a main body 20*m*, a first end 20*a*, and a second end 20*b*. The main body 20*m* has a rectangular flat plate shape. The first end 20*a* is connected to one end of the main body 20*m* in the longitudinal direction, while the second end 20*b* is connected to the other end of the main body 20*m* in the longitudinal direction. Each of the first end 20*a* and the second end 20*b* is formed as a terminal. The first end 20*a* can be connected to a terminal 101 of a connector 100 on the input side and can also be connected to the second end 20*b* of another first conductor 2.

In the following description, an extending direction of the trunk portion 20 is referred to as a "first direction X". The first direction X is a longitudinal direction of the trunk portion 20. The width direction of the trunk portion 20 is referred to as a "second direction Y". The second direction Y is orthogonal to the first direction X. A direction orthogonal to both the first direction X and the second direction Y is referred to as a "third direction Z". The third direction Z is a thickness direction of the trunk portion 20.

The branch portion 21 diverges from the main body 20*m* in the second direction Y. The shape of the branch portion 21 in the illustrated example is a rectangular flat plate shape. The branch portion 21 has an output terminal portion 22 having a flat plate shape. The output terminal portion 22 can be connected to a terminal 201 of a mating connector 200.

The second conductor 3 includes a trunk portion 30 and a branch portion 31. The trunk portion 30 extends in straight line in the first direction X and includes a main body 30*m*, a first end 30*a*, and a second end 30*b*. The configurations of the main body 30*m*, the first end 30*a*, and the second end 30*b* are similar to the configurations of the main body 20*m*, the first end 20*a*, and the second end 20*b*. The first end 30*a* can be connected to a terminal 102 of the connector 100 and can also be connected to the second end. 30*b* of another second conductor 3.

The branch portion 31 diverges from the main body 30*m* in the second direction Y. The distal end of the branch portion 31 has an output terminal portion 32 having a flat plate shape. The output terminal portion 32 can be connected to a terminal 202 of the mating connector 200. The branch portion 31 is bent so as to intersect three-dimensionally with the trunk portion 20. More specifically, the branch portion 31 has a crossing portion 33 protruding in the third direction Z. The branch portion 31 is formed so as to be able to maintain a necessary distance between the crossing portion 33 and the trunk portion 20.

The third conductor 4 includes a trunk portion 40 and a branch portion 41. The trunk portion 40 extends in straight line in the first direction X and includes a main body 40*m*, a first end 40*a*, and a second end 40*h*. The configurations of the main body 40*m*, the first end 40*a*, and the second end 40*b* are similar to the configurations of the main body 20*m*, the first end 20*a*, and the second end 20*b*. The first end 40*a* can be connected to a terminal 103 of the connector 100 and can also be connected to the second end. 40*b* of another third conductor 4.

The branch portion 41 diverges from the main body 40*m* in the second direction Y. The distal end of the branch portion 41 has an output terminal portion 42 having a flat plate shape. The output terminal portion 42 can be connected to a terminal 203 of the mating connector 200. The branch portion 41 is bent so as to intersect three-dimensionally with the trunk portions 20 and 30. More specifically, the branch portion 41 has a crossing portion 43 protruding in the third direction Z. The branch portion 41 is formed so as to be able to maintain a necessary distance between the crossing portion 43 and the trunk portions 20 or 30.

The housing 5 of the present embodiment holds the first conductor 2, the second conductor 3, and the third conductor 4 such that the main bodies 20*m*, 30*m*, and 40*m* and the output terminal portions 22, 32, and 42 are located on a same plane. In the housing 5, the main bodies 20*m*, 30*m*, and 40*m* are arranged in parallel in the second direction Y. In the housing 5, the output terminal portions 22, 32, and 42 are arranged in parallel in the first direction X. The output terminal portions 22, 32, and 42 protrude from the housing 5 in the second direction Y. The housing 5 may have an engaging portion to be engaged with the conductors 2, 3, and 4, or may be formed by in-mold processing with respect to the conductors 2, 3, and 4.

As illustrated in FIG. 4, the first end 20*a* protrudes from the main body 50 of the housing 5 in the first direction X. Similarly, the first ends 30*a* and 40*a* Protrude from the main body 50 in the first direction X. The first coupling portion 51 of the housing 5 has a flat plate shape and protrudes from the main body 50 in the first direction X. The first coupling portion 51 faces the first ends 20*a*, 30*a*, and 40*a* in the third direction 7. That is, the first coupling portion 51 is disposed on the first ends 20*a*, 30*a*, and 40*a* side of the housing 5. The first coupling portion 51 covers the first ends 20*a*, 30*a*, and 40*a* from one side in the third direction Z, making it possible to protect the first ends 20*a*, 30*a*, and 40*a*.

The first end 20*a* has a protrusion 20*c*. The protrusion 20*c* is curved toward a side opposite to the side of the first coupling portion 51. The first ends 30*a* and 40*a* have protrusions 30*c* and 40*c* similar to the protrusion 20*c*.

As illustrated in FIG. 2, main body 50 of the housing 5 has the second coupling portion 52. The second coupling portion 52 is disposed at an end opposite to the first coupling portion 51 in the first direction X. The second coupling portion 52 of the present embodiment is a recess that is recessed in the first direction X. The cross-sectional shape of the second coupling portion 52 in a cross section orthogonal to the first direction X is rectangular. The second ends 20*b*, 30*b*, and 40*b* are exposed to the internal space of the second coupling portion 52.

As illustrated in FIG. 5, the two connecting units 10 are coupled to each other by the first coupling portion 51 and the second coupling portion 52. Here, one connecting unit 10 is referred to as a first unit 10A, and the other connecting unit 10 is referred to as a second unit 10B. The first coupling portion 51 of the second unit. 10B is inserted into the second coupling portion 52 of the first unit 10A and is fitted with the second coupling portion 52. At this time, the first ends 20*a*, 30*a*, and 40*a* of the second unit 10B are inserted into the second coupling portion 52 of the first unit 10A together with the first coupling portion 51.

As illustrated in FIG. 5, the first coupling portion 51 is configured to press the first end 40*a* of the second unit 10B against the second end 40*b* of the first unit 10A, The first end 40*a* inserted into the second coupling portion 52 comes contact with the second end 40*h* and receives a reaction force F1 in the third direction Z. The first coupling portion 51 supports the trunk portion 40 against the reaction force F1, and presses the first end 40*a* toward the second end 40*b*. This allows the first end. 40*a* to be electrically connected to the second end 40*b*. Similarly, the first coupling portion 51 connects the first ends 20*a* and 30*a* of the second unit 10B to the second ends 20*b* and 30*h* of the first unit 10A. That is, the first coupling portion 51 and the first ends 20*a*, 30*a*, and

40*a* of the present embodiment are press-fitted into the second coupling portion 52. The first ends 20*a*, 30*a*, and 40*a* are housed in the second coupling portion 52 while pressing the second ends 20*h*, 30*b*, and 40*h*.

As illustrated in FIG. 5, the first end 40*a* of the first unit 10A is connected to the terminal 103 of the connector 100 on the input side. The connector 100 includes, for example, a coupling portion 104 similar to the second coupling portion 52. In this case, the first coupling portion 51 is inserted into the coupling portion 104 of the connector 100 to connect the first end 40*a* to the terminal 103. Similarly, the first coupling portion 51 connects the first ends 20*a* and 30*a* respectively to the terminal 101 and 102 of the connector 100.

The joint connector 1 of the present embodiment capable of coupling three or more connecting units 10. The individual connecting unit 10 are connected in series to the connector 100 on the input side. That is, the plurality of connected connecting units 10 extend in the first direction X.

As illustrated in FIG. 1, the mating connector 200 is connected to the connecting unit. 10 in the second direction Y. One connector 200 is connected to one connecting unit 10. The connector 200 includes terminals 201, 202, and 203. The terminals 201, 202, 203 may be female terminals. The output terminal portions 22, 32, and 42 of the connecting unit 10 are connected to the terminals 201, 202, and 203, respectively.

The joint connector 1 connects the connector 100 on the input side to a plurality of connectors 200 as mating connectors. For example, when the connector 100 has a power supply terminal, the joint connector 1 connects the power supply terminal to a power supply terminal of each of the connectors 200. In other words, the joint connector 1 distributes the power supplied via the connector 100 to the plurality of connectors 200. When the connector 100 has a communication terminal, the joint connector 1 connects the communication terminal to a communication terminal of each of the connectors 200, In other words, the joint connector 1 communicably connects the communication device connected to the connector 100 to a communication device connected to each of the connectors 200. When the connector 100 has a ground terminal, the joint connector 1 connects the ground terminal to a ground terminal of each of the connectors 200.

As described above, the joint connector 1 of the present embodiment includes the connecting unit 10 that can be coupled to each other. One connecting unit 10 includes: a plurality of plate-shaped conductors 2, 3, and 4; and the housing 5 that holds the plurality of conductors 2, 3, and 4. The conductors 2, 3, and 4 include: trunk portions 20, 30, and 40 each having a straight line shape and extending in the first direction X; and branch portions 21, 31, and 41, respectively. The trunk portions 20, 30, and 40 respectively include the first ends 20*a*, 30*a*, and 40*a*, and the second ends 20*b*, 30*b*, and 40*b*. The branch portions 21, 31, and 41 diverge from the trunk portions 20, 30, and 40 respectively in the second direction Y.

The branch portions 21, 31, and 41 include output terminal portions 22, 32, and 42 respectively connected to the terminals 201, 202, and 203 of the other connectors 200, The housing 5 holds the plurality of conductors 2, 3, and 4 in a state where the output terminal portions 22, 32, and 42 of the plurality of conductors 2, 3, and 4 are respectively arranged in parallel in the first direction X on the same plane. The housing 5 includes: the first coupling portion 51 disposed on the side of the first ends 20*a*, 30*a*, and 40*a*; and the second coupling portion 52 disposed on the side of the second ends 20*b*, 30*b*, and 40*b*. By coupling the first coupling portion 51 of one housing 5 and the second coupling portion 52 of another housing 5, the first ends 20*a*, 30*a*, and 40*a* of the conductors 2, 3, and 4 are connected with the second ends 20*b*, 30*b*, and 40*b* of the other conductors 2, 3, and 4, respectively.

In the joint connector 1 of the present embodiment, the trunk portions 20, 30, and 40 extend in the first direction X, while the output terminal portions 22, 32, and 42 are arranged in parallel in the first direction X on the same plane. The plurality of connected connecting units 10 extend in the first direction X. Accordingly, the present embodiment can achieve reduction of the height of the joint connector 1.

In the housing 5 of the present embodiment, the trunk portions 20, 30, and 40 of the plurality of conductors 2, 3, and 4 are arranged in parallel in the second direction Y on the same plane. The branch portions 31 and 41 of one conductor respectively have crossing portions 33 and 43 crossing the trunk portion of the other conductor. For example, the branch portion 41 of the third conductor 4 includes the crossing portion 43 that crosses the trunk portion 20 of the first conductor 2 and the trunk portion 30 of the second conductor 3. With such a configuration, it is possible to arrange the trunk portions 20, 30, and 40 and the output terminal portions 22, 32, and 42 on a same plane while achieving reduction of the height of the housing 5.

The housing 5 of the present embodiment has the main body 50 having a rectangular parallelepiped shape. The first ends 20*a*, 30*a*, and 40*a* of the conductors 2, 3, and 4 Protrude from the main body 50. The first coupling portion 51 is a plate-shaped protruding portion protruding from the main body 50. The first coupling portion 51 faces the first ends 20*a*, 30*a*, and 40*a* of the plurality of conductors 2, 3, and 4. The second coupling portion 52 is a recess formed in the main body 50. The second ends 20*b*, 30*b*, and 40*h* of the conductors 2, 3, and 4 are exposed to the internal space of the second coupling portion 52. With the first coupling portion 51 fitted with the second coupling portion. 52, the first ends 20*a*, 30*a*, and 40*a* of the conductors 2, 3, and 4 are connected with the second ends 20*b*, 30*b*, and 40*b* of the other conductors 2, 3, and 4, respectively. Such a configuration makes it possible to reduce the height of the joint connector 1.

The number of conductors held by the housing 5 may be two, or four or more. The conductors 2, 3, and 4 may be formed by combining a plurality of metal plates. For example, in the second conductor 3, the trunk portion 30 and the branch portion 31 may be different metal plates. In this case, the trunk portion 30 and the branch portion 31 are preferably joined by welding or the like.

One of the first ends 20*a*, 30*a*, and 40*a* and the second ends 20*b*, 30*b*, and 40*h* may have a male terminal shape, and the other may have a female terminal shape. For example, the first ends 20*a*, 30*a*, and 40*a* may be formed as male terminals, and the second ends 20*b*, 30*h*, and 40*b* may be formed as female terminals.

The trunk portions 20, 30, and 40 need not be arranged on a same plane. For example, the positions of the trunk portions 20, 30, and 40 in the third direction Z may be different from each other.

First Modification of Embodiment

Figure 6:
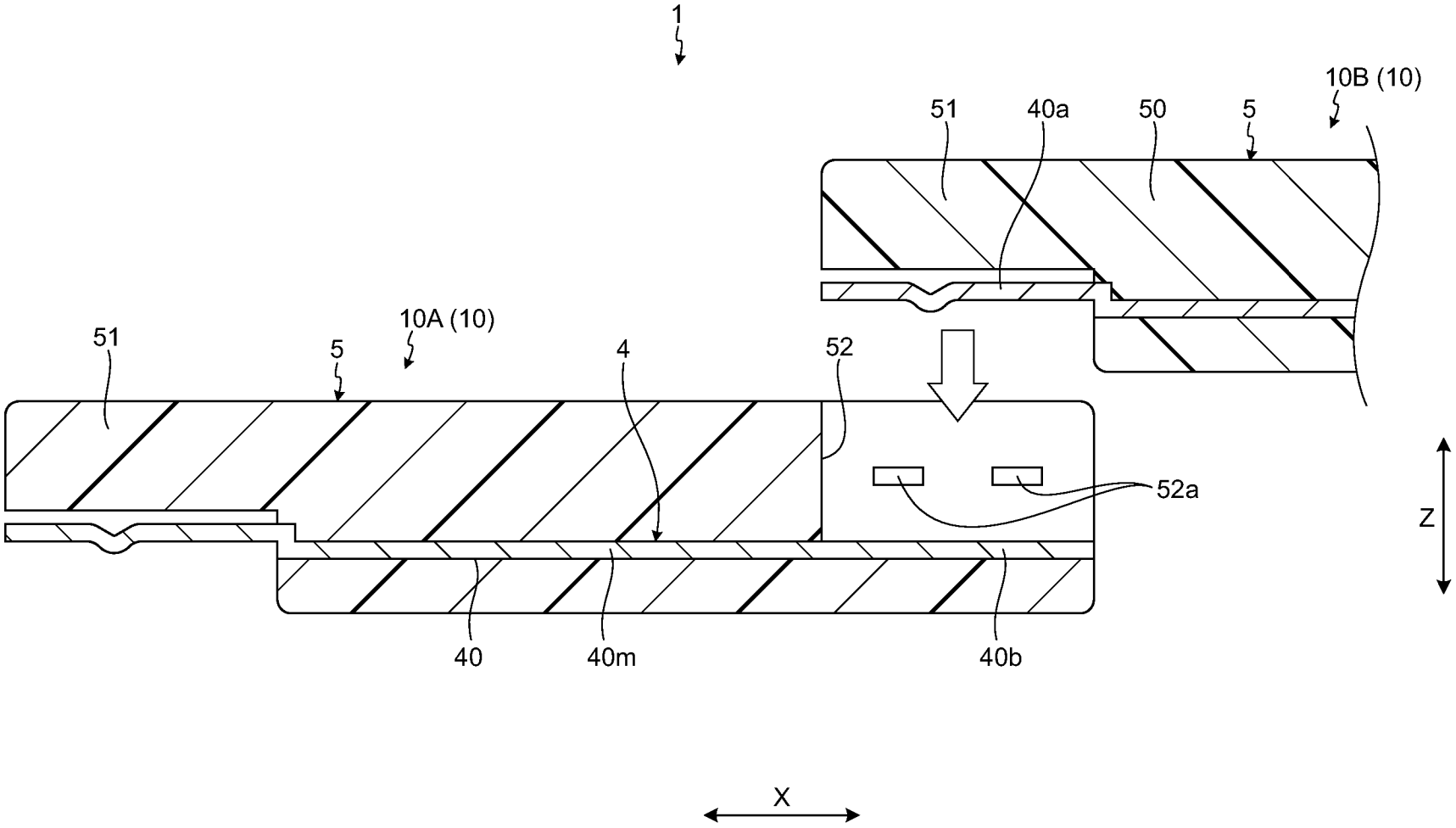
FIG. 6 is a cross-sectional view of a joint connector according to a first modification of the embodiment.

A first modification of an embodiment will be described. FIG. 6 is a cross-sectional view of a joint connector according to the first modification of the embodiment. As illustrated in FIG. 6, the connecting unit 10 may be coupled while relatively moving in the third direction Z. The second coupling portion 52 illustrated in FIG. 6 is open in the third direction Z. The first coupling portion 51 is engaged with the second coupling portion 52 in the third direction Z. On a wall surface of the second coupling portion 52, there is provided a locking portion 52*a* that locks the first coupling portion 51. The first coupling portion 51 is preferably provided with a lock receiving portion corresponding to the locking portion 52*a*. The lock receiving portion is, for example, a claw or a recess provided on a side surface of the first coupling Portion 51.

By coupling the first coupling portion 51 and the second coupling portion 52 to each other, the first ends 20*a*, 30*a*, and 40*a* of the second unit 10B and the second ends 20*b*, 30*b*, and 40*b* of the first unit 10A are respectively connected to each other.

The techniques disclosed in the above embodiments and modification can be implemented in appropriate combination with each other.

In the joint connector according to the present embodiment, the trunk portions extend in the first direction, and the output terminal portions are arranged in parallel in the first direction on the same plane. The connecting unit coupled to each other extends in the first direction. Therefore, the joint connector according to the present invention makes it possible to achieve a reduction in height.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A joint connector comprising:

one or more connecting units that can be coupled to each other, wherein one of the connecting units includes: a plurality of conductors each having a plate-like shape; and a housing that holds the plurality of conductors, the conductor includes: trunk portions each of which having a straight line shape, extending in a first direction, and having a first end and a second end; and branch portions each of which diverging from the trunk portions in a second direction orthogonal no the first direction, the branch portion includes an output terminal portion connected to a terminal of another connector, the housing holds the plurality of conductors in a state where the output terminal portions of the plurality of conductors are arranged in parallel in the first direction on a same plane, the housing includes: a first coupling portion disposed on a side of the first end; and a second coupling portion disposed on a side of the second end, and the first coupling portion of one of the housings and the second coupling portion of another one of the housings are coupled each other, causing the first end of the conductor and the second end of another one of the conductors to be connected to each other.

2. The joint connector according to claim 1, wherein the housing has a configuration in which the trunk portions of the plurality of conductors are arranged in parallel in the second direction on a same plane, and the branch portion of one of the conductors has a crossing portion crossing the trunk portion of another one of the conductors.

3. The joint connector according to claim 1, wherein the housing includes a main body having a rectangular parallelepiped shape, the first end protrudes from the main body, the first coupling portion is a plate-shaped protruding portion protruding from the main body and faces the first ends of the plurality of conductors, the second coupling portion is a recess formed in the main body, the second end is exposed to an internal space of the second coupling portion, and the first coupling portion and the second coupling portion are fitted with each other, causing the first end of the conductor and the second end of another one of the conductors are connected to each other.

4. The joint connector according to claim 2, wherein the housing includes a main body having a rectangular parallelepiped shape, the first end protrudes from the main body, the first coupling portion is a plate-shaped protruding portion protruding from the main body and faces the first ends of the plurality of conductors, the second coupling portion is a recess formed in the main body, the second end is exposed to an internal space of the second coupling portion, and the first coupling portion and the second coupling portion are fitted with each other, causing the first end of the conductor and the second end of another one of the conductors are connected to each other.

* * * * *